United States Patent [19]

Sheu

[11] Patent Number: 5,076,394

[45] Date of Patent: Dec. 31, 1991

[54] COMBINED CASING AND MOUNTING ASSEMBLY FOR A DESCENT DEVICE

[75] Inventor: Yin-Ping Sheu, Kaohsiung, Taiwan

[73] Assignee: Por-Jiy Sheu, Taipei, Taiwan

[21] Appl. No.: 569,085

[22] Filed: Aug. 17, 1990

[51] Int. Cl.[5] ..... A62B 1/00

[52] U.S. Cl. ..... 182/70; 182/5

[58] Field of Search ..... 182/70, 76, 82, 100, 182/5-7

[56] References Cited

U.S. PATENT DOCUMENTS

| | | | |
|---|---|---|---|
| 819,956 | 5/1906 | Thompsen | 182/70 |
| 1,123,029 | 12/1914 | Smith | 182/70 |
| 2,230,786 | 2/1941 | Sutt | 182/70 |
| 2,852,175 | 9/1958 | Scott | 182/70 |
| 4,381,046 | 4/1983 | Landen | 182/70 |

*Primary Examiner*—Reinaldo P. Machado

*Attorney, Agent, or Firm*—Ladas & Parry

[57] ABSTRACT

A combined casing and mounting assembly for a descent device to be contained by the assembly when not in use and to be suspended from the assembly when in use includes an enclosed hollow casing which has a rear panel to be fixed to a wall of a building, a side panel having one edge hinged to the rear panel, and a cover panel hinged to another edge of the side panel opposite the rear panel. The side panel and the cover panel can be turned from an enclosing storage position relative to the rear panel to an open position in which the cover panel extends through an opening in the wall. The descent device is to be suspended from the cover panel of the assembly when in use. The assembly further includes a positioning device to maintain the cover panel in the openn position and a fastening device to maintain the cover panel in the storage position.

3 Claims, 6 Drawing Sheets

COMBINED CASING AND MOUNTING ASSEMBLY FOR A DESCENT DEVICE

BACKGROUND OF THE INVENTION

The invention relates to a foldable casing, more particularly to a combined casing and mounting assembly that acts as a support and as storage means for an emergency descent device.

The objective of the present invention is to provide a novel dual purpose casing assembly which can be mounted on a wall inside a room near a window or door. The assembly provides storage space for a descent device when the descent device is not in use, and acts as a support for the descent device when the descent device is used as a means of escape from a fire or other similar emergency.

SUMMARY OF THE INVENTION

Accordingly, the preferred embodiment of a combined casing and mounting assembly of the present invention comprises an enclosed hollow casing which includes a rear panel to the fixed to a wall, A side panel having one edge hinged to the rear panel, and a cover panel hinged to another edge of the side panel opposite the rear panel. The side panel and the cover panel can be turned from an enclosing storage position relative to the rear panel to an open position in which the cover panel extends through an opening in the wall. A descent device is to be contained by the assembly when the descent device is not in use. The descent device is to be suspended from a suspension hole of the cover panel of the assembly when in use. The assembly further comprises a positioning means maintain the cover panel in open position and a fastening means to maintain the cover panel in the storage position. The positioning means includes a pair of hollow bodies to be separately mounted to the wall at the opening, at locations immediately above and below the cover panel when the cover panel is in the open position. Each hollow body confines a receiving space to receive a tenon normally biased to project out of the hollow body. The tenon has an engaging face to prevent movement of the cover panel towards the storage position and a curved guide face to guide the cover panel to move past the tenon so that the engaging face engages the cover panel.

BRIEF DESCRIPTION OF THE DRAWINGS

Other features and advantages of this invention will become apparent in the following detailed description of the preferred embodiment with reference to the accompanying drawings, in which.

DETAILED DESCRIPTION OF THE PREFERRED EMBODIMENT

Figure 1:
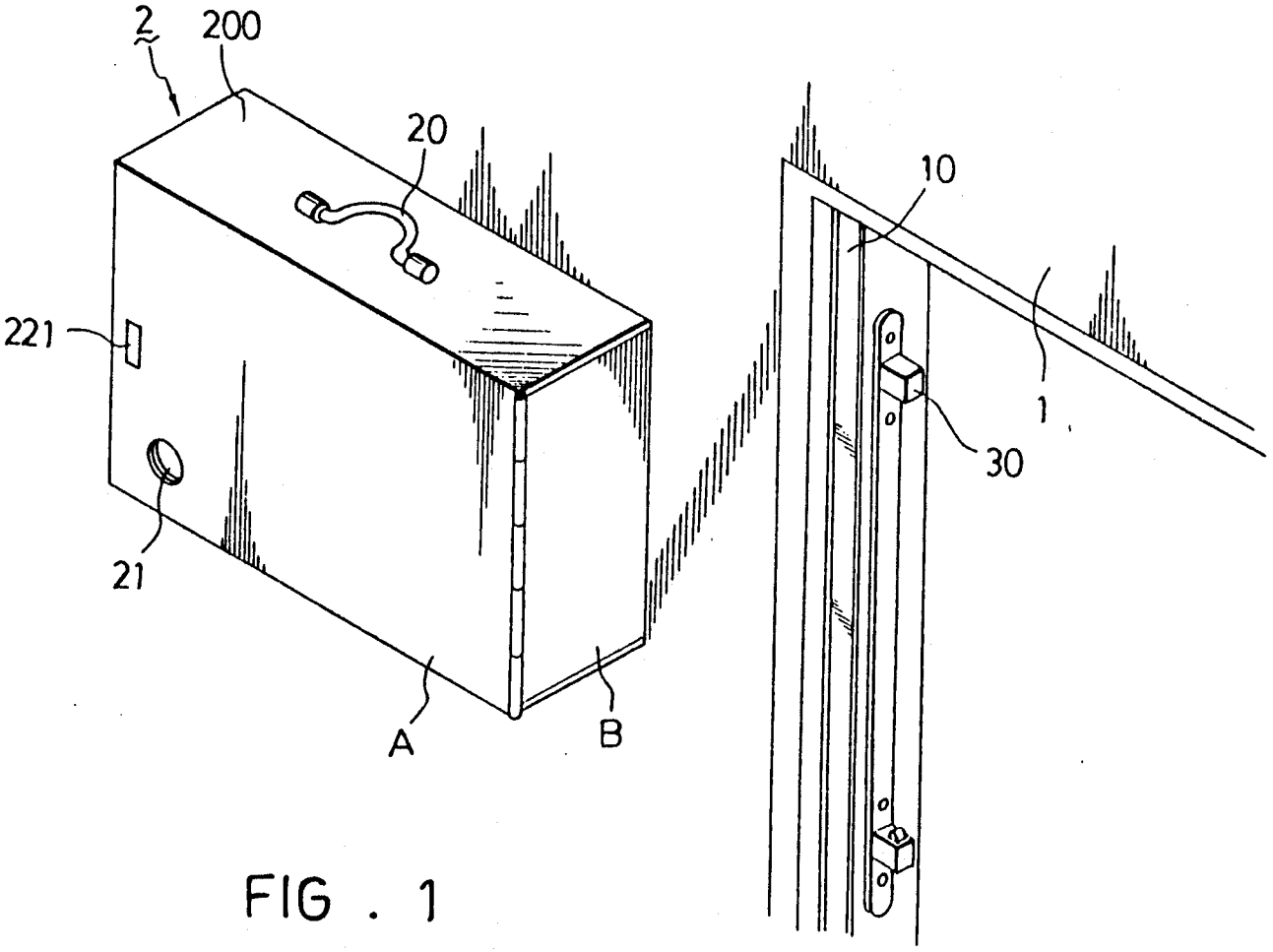
FIG. 1 illustrates the preferred embodiment when properly mounted on a wall.

Referring to FIG. 1, the preferred embodiment of a combined casing and mounting assembly for a descent device is shown to comprise an enclosed hollow rectangular casing 2 attached to the inner face 1 of a wall inside a room of a building at a position adjacent to a window or door 10. The casing 2 has a side panel B which is displaced from the opening 10 by a distance equal to its width. The casing 2 has a top panel 200 with a handle 20 to facilitate mounting of the casing 2 on the inner face 1. The casing 2 further has a rectangular cover panel A with a suspension hole 21 formed near a lower edge. A descent device (see FIG. 4) is to be suspended from the cover panel A at the suspension hole 21. The descent device is stored inside the casing 2 when not in use.

Figure 2:
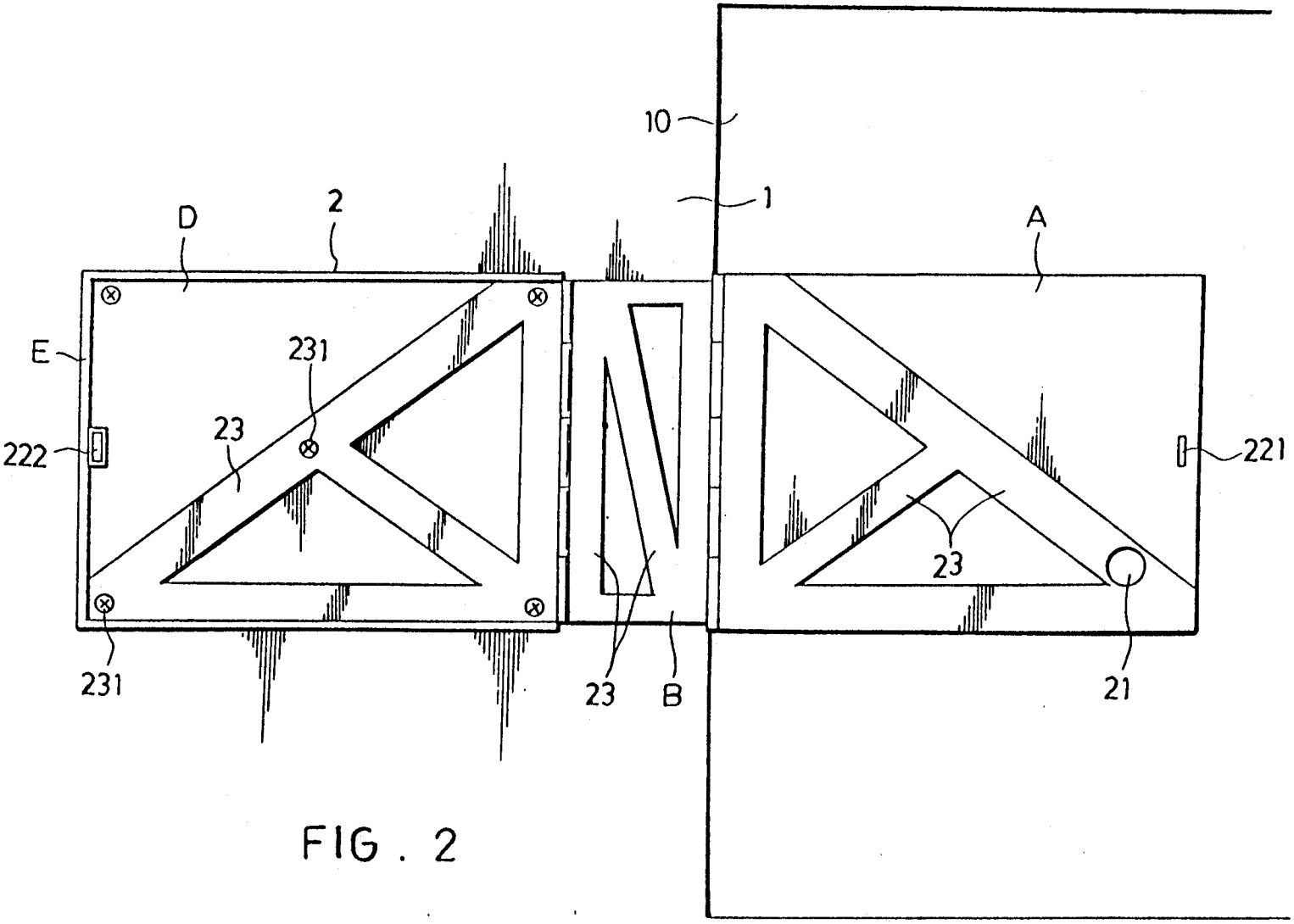
FIG. 2 is a schematic view illustrating the reinforcement of the preferred embodiment.

Referring to FIG. 2, the front panel A is hinged to one edge of the side panel B, while the opposite edge of the side panel B is hinged to a rear panel D. The cover panel A has an engaging slot 221 which receives an engaging member 222 attached to a side panel E of the casing 2 opposite to the side panel B. A plurality of mounting members 231 is used to fix the rear panel D to the inner face 1. Reinforcing members 23 are attached to the side panel B, the cover panel A and the rear panel D to strengthen and add to the stability of the casing 2.

Figure 3:
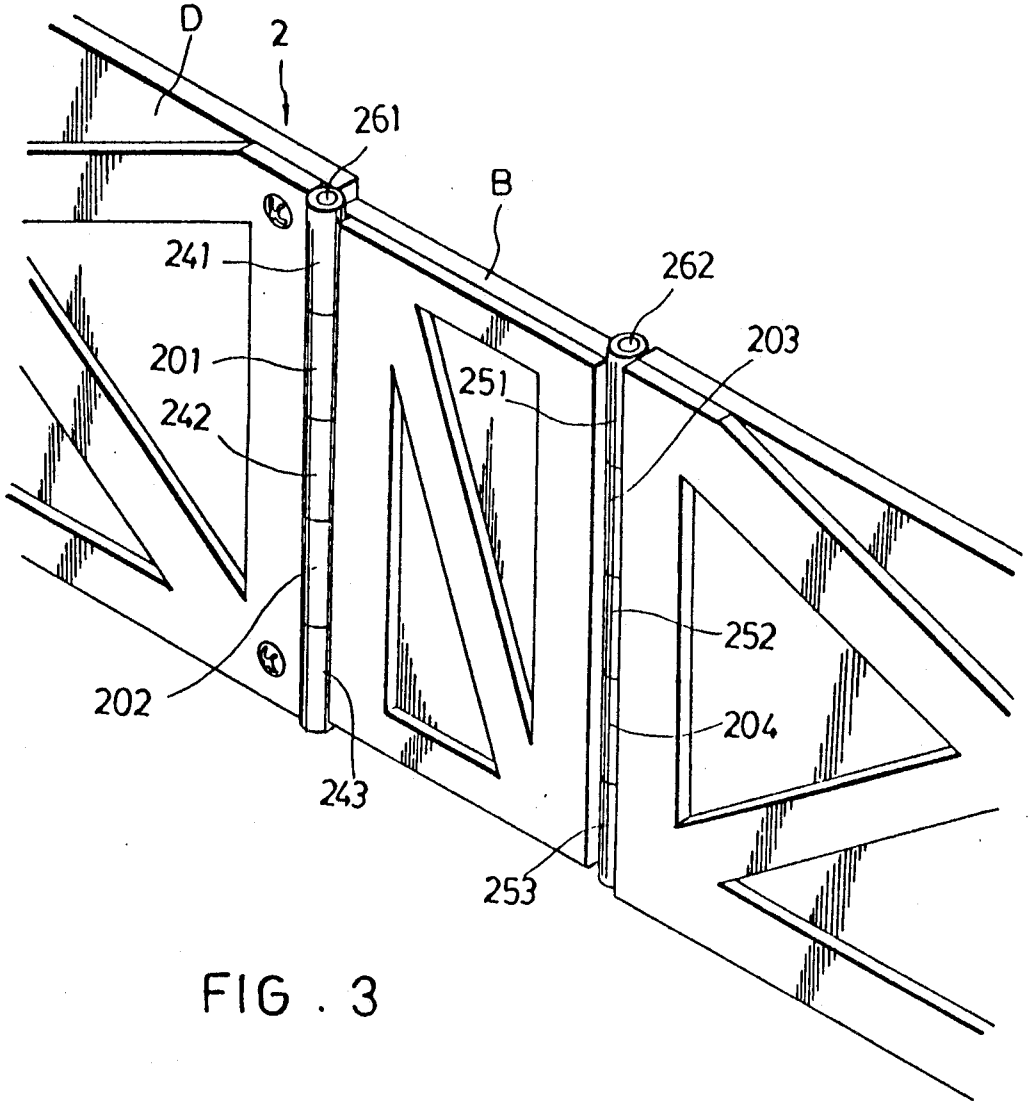
FIG. 3 is an enlarged perspective view illustrating hinge connections between the cover panel, the side panel, and the rear panel of the preferred embodiment.

Referring to FIGS. 2 and 3, the side panel B has three spaced first pin receiving tubes 241, 242, and 243 disposed on an edge adjacent to the rear panel D and three spaced second pin receiving tubes 251, 252, and 253 disposed on an edge adjacent to the cover panel A. The rear panel D has pin receiving tubes 201 and 202 each disposed between two consecutive first pin receiving tubes 241, 242, and 243. The cover panel A has pin receiving tubes 203 and 204 each being similarly disposed between two consecutive second pin receiving tubes 251, 252 and 253. A first hinge pin 261 extends into the pin receiving tubes 241, 201, 242, 202 and 243. A second hinge pin 262 extends into the pin receiving tubes 251, 203, 252, 204, and 253. The first hinge pin 261 permits the rotation of the side panel B relative to the rear panel D. The second hinge pin 262 permits the rotation of the cover panel A relative to the side panel B.

Figure 4:
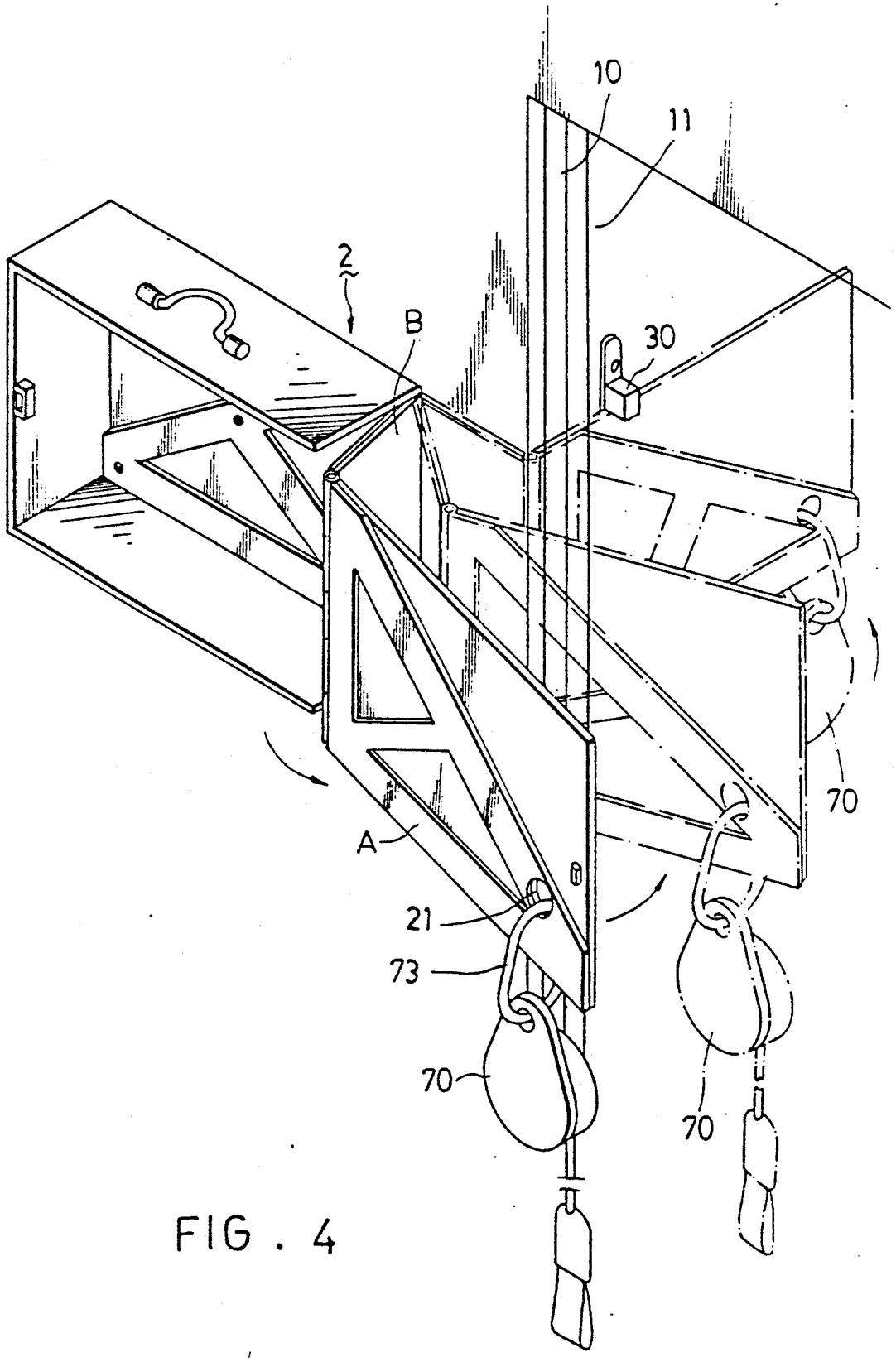
FIG. 4 is a perspective view illustrating movement of the cover panel and the side panel from an enclosing storage position to the open position.
Figure 5:
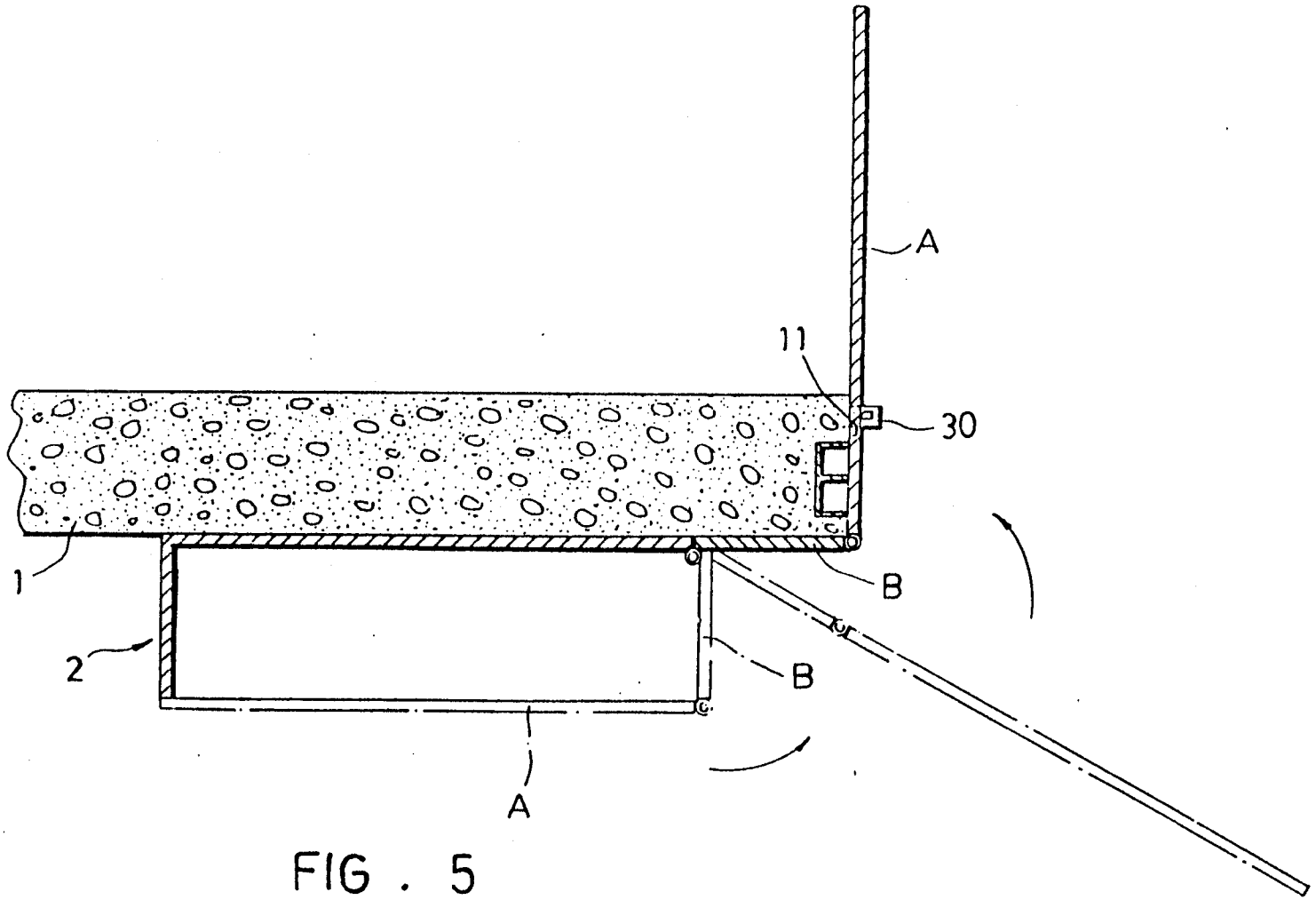
FIG. 5 is a top sectional view of FIG. 4.

FIGS. 4 and 5 illustrate the movement of the cover panel A and the side panel B from a storage position to an open position. When in the open position. the side panel B is coplanar with the rear panel D. The cover panel A is at right angles with the side panel B and extends through the opening 10. A positioning means 30, attached to the wall at a side 11 defining the opening 10 and transverse to the inner face 1, is provided to maintain the cover panel A in the open position. Referring to FIG. 4, a descent device 70 has a hooking ring 73 engaged to the cover panel A at the suspension opening 21. In case of fire or any similar emergency, the user hangs onto a rope, which is suspended from the descent device 70 in a pulley-like fashion, in order to escape tragic consequences.

Figure 7:
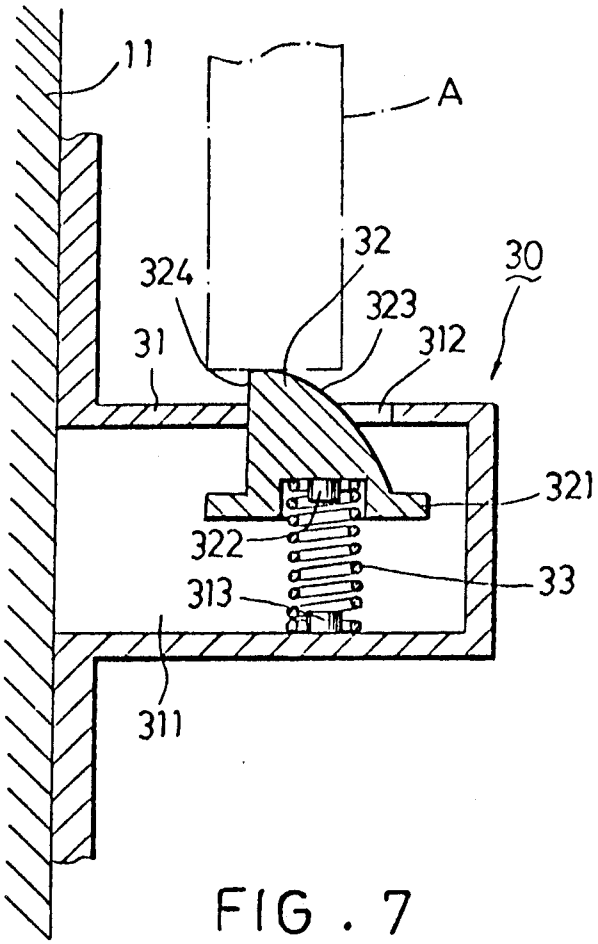
FIG. 7 illustrates the actuation of the positioning means by the cover panel of the preferred embodiment.
Figure 6:
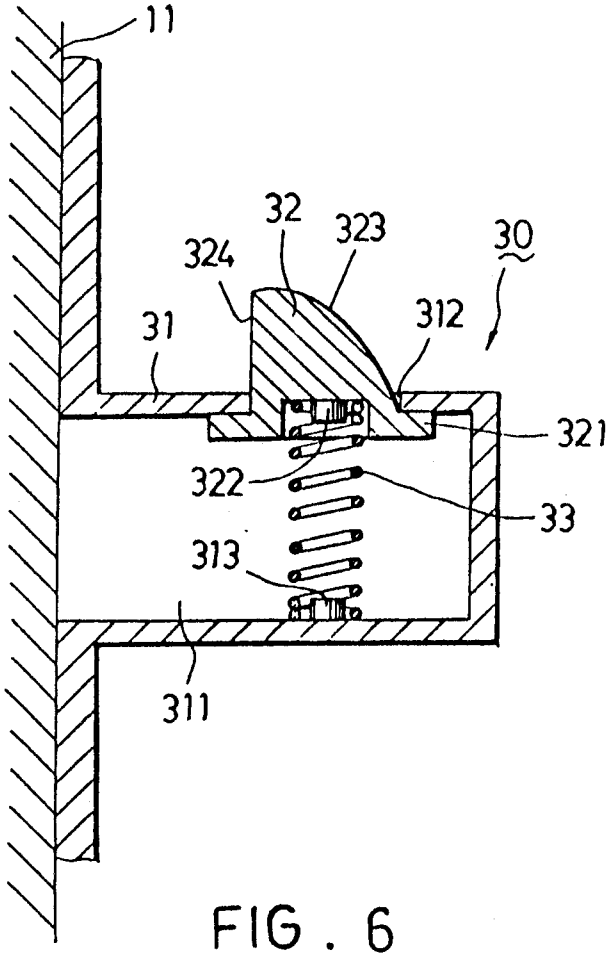
FIG. 6 is a sectional view of a positioning means of the preferred embodiment.

Referring to FIGS. 1, 6 and 7, the positioning means 30 comprises a pair of hollow bodies 31 mounted to the side 11 at locations immediately above and below the cover panel A when the cover panel A is in the open position. Each hollow body 31 confines a receiving space 311 to receive a tenon 32 and a spring 33. The tenon 32 is urged by the spring 33 to project out of the hollow body 31 at an opening 312 in the same. The tenon 32 has a peripheral flange 321 which prevents it from disengaging from the hollow body 31. Referring to FIGS. 6 and 7, the tenon 32 has an axially projecting stub 322. The hollow body 31 similarly has an axially projecting stub 313 aligned with the stub 322. The stubs 313 and 322 are provided to properly position the spring 33 inside the receiving space 311.

Referring once more to FIG. 7, the cover panel A contacts a curved guide face 323 of the tenon 32 as the cover panel A moves towards the side 11 of the wall. The tenon 32 is forced down and the spring 33 is compressed to premit movement of the cover panel A past the tenon 32. Once the cover panel A has moved past the tenon 32, the spring 33 expands to push the tenon 32 upward. The tenon 32 has an engaging face 324 which prevents movement of the cover panel A away from the side 11 towards the storge position.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A combined casing and mounting assembly for a descent device to be contained by said assembly when not in use and to be suspended from said assembly when in use, said assembly being mountable on a wall having an opening, said assembly comprising:

an enclosed hollow casing including a rear panel to be fixed to the wall, a side panel having one edge hinged to said rear panel, and a cover panel hinged to another edge of said side panel opposite said rear panel, said side panel forming an angle with said rear panel and said cover panel forming another angle with said side panel and being opposite to said rear panel when in a storage position, said side panel and said cover panel being turnable to an open position in which said cover panel extends through the opening, said cover panel having means for suspending the descent device; and a positioning means to maintain said cover panel in said open position, said positioning means including a hollow body to be mounted to the wall at the opening at a location immediately below said cover panel when said cover panel is in said open position, said hollow body confining a receiving space, said positioning means further including a tenon disposed inside said receiving space and normally biased to project out of said hollow body, said tenon having an engaging face to prevent movement of said cover panel towards said storage position and a curved guide face to guide said cover panel to move past said tenon so that said engaging face engages said cover panel.

2. The combined casing and mounting assembly as claimed in claim 1, further comprising fastening means to maintain said cover panel in said storage position.

3. The combined casing and mounting assembly as claimed in claim 1, wherein said descent device suspending means is a suspension hole.

* * * * *